United States Patent [19]

Yang

[11] Patent Number: 4,732,373

[45] Date of Patent: Mar. 22, 1988

[54] SERVO-CLAMPING DEVICE

[76] Inventor: Tai-Her Yang, 5-1 Taipin St., Si-Hu Town, Dzan-Hwa, Taiwan

[21] Appl. No.: 743,981

[22] Filed: Jun. 12, 1985

Related U.S. Application Data

[63] Continuation-in-part of Ser. No. 564,319, Dec. 22, 1983, Pat. No. 4,632,375.

[51] Int. Cl.[4] ..... B25B 1/24

[52] U.S. Cl. ..... 269/241; 269/258; 269/265

[58] Field of Search ..... 269/257–259, 269/261–262, 265, 268, 242, 241

[56] References Cited

U.S. PATENT DOCUMENTS

| | | | |
|---|---|---|---|
| 1,368,399 | 2/1921 | Jerrim | 269/258 |
| 1,405,325 | 1/1922 | Posch | 269/258 |
| 1,994,217 | 3/1935 | Guillaix | 269/258 |
| 2,724,296 | 11/1955 | Parrish | 269/258 X |

FOREIGN PATENT DOCUMENTS

| | | | |
|---|---|---|---|
| 126547 | 9/1931 | Austria | 269/241 |
| 920599 | 10/1954 | Fed. Rep. of Germany | 269/261 |
| 20721 | 11/1945 | Finland | 269/268 |
| 541791 | 4/1956 | Italy | 269/261 |
| 771688 | 4/1957 | United Kingdom | 269/241 |

*Primary Examiner*—Robert C. Watson
*Attorney, Agent, or Firm*—Leonard Bloom

[57] ABSTRACT

A clamping apparatus includes two pairs of rotatable and substantially cylindrical clamping elements positioned on jaws of the clamping apparatus. One pair of clamping elements is located on a fixed jaw, and the second pair is located on a movable vise jaw. The jaws are supported on a generally rectangular base which has a pair of end portions. One end portion is a first upstanding flange formed integrally with the base. The second end portion is the fixed jaw. A two-way threaded rod is carried by the movable vise jaw and one threaded end extends through a cooperating threaded recess in the first upstanding flange. The movable vise jaw has a transverse notch located in its bottom to receive a hollow cylindrical nut which is internally threaded in a first direction. Adjacent to the cylindrical nut is a friction ring. The second threaded end of the threaded rod, threaded in the second direction, is threaded into the cylindrical nut. There are two speeds for moving the movable vise member towards the fixed member. One speed of movement occurs when the clamping members are not in engagement with the workpiece. The second speed of movement occurs when the clamping members are engaging the workpiece.

5 Claims, 8 Drawing Figures

SERVO-CLAMPING DEVICE

CROSS-REFERENCE TO CO-PENDING APPLICATION

The patent is based upon a continuation-in-part application of abandoned application Ser. No. 564,319 filed Dec. 22, 1983 now U.S. Pat. No. 4,632,375.

FIELD OF THE INVENTION

The present invention relates to the field of clamping devices, and more particularly to clamping devices having a fixed jaw and a movable jaw.

BACKGROUND OF THE INVENTION

In the art of clamping devices it would be desirable to provide a movable jaw clamping apparatus that accommodates itself to irregularly shaped workpieces. It would also be desirable to provide a clamping apparatus having a movable jaw that rapidly approaches the fixed jaw before the workpiece is contacted but moves more slowly toward the fixed jaw when the workpiece is contacted.

SUMMARY OF THE INVENTION

Accordingly, it is a primary object of the present invention to provide a clamping device that accommodates itself to irregularly shaped workpieces and that has a movable jaw that rapidly approaches the fixed jaw before the workpiece is contacted and moves more slowly once the workpiece is encountered.

In accordance with the teachings of the present invention, a preferred embodiment is herein disclosed, wherein the clamping apparatus includes a base, a pair of vise jaws, a threaded rod, and pairs of clamping members which are located in concave recesses in the vise jaws. At least one vise jaw is movable and at least one is fixed. The threaded rod is used for moving the vise jaws towards and away from one another. The concave recesses in the vise jaws are formed laterally of each other and receive clamping members which have complementary convex surfaces. The concave recesses and convex surfaces are formed about a vertical axis, wherein, in a cross-sectional plane substantially at right angles to the respective axes, each axis forms the center of a circle substantially defining the respective concave recesses and convex surfaces. The base has means for supporting each clamping member for pivotable movement about its respective vertical axis. Each of the clamping members has a plurality of substantially-flat chordal faces intersecting one another and disposed oppositely of the convex surface on the respective clamping member. The chordal faces on one pair of clamping members on a respective vise jaw confront the chordal faces on the other pair of clamping members on the other respective vise jaw thereby engaging and securely retaining a workpiece between the respective vise jaws.

In accordance with another aspect of the invention, a servoclamping device includes a generally rectangular base having a pair of end portions. A first upstanding flange is formed integrally with the base at one end portion. A second upstanding flange is formed integrally with the base at the other end thereof and constitutes a fixed vise member. The base has a slideway formed therein substantially longitudinally thereof. A movable vise member is slidably received within the slideway. A threaded rod is carried by the movable vise member and extends through a cooperating threaded recess in the first upstanding flange at the one end portion of the base.

The second upstanding flange at the other end of the base has a first pair of spaced-apart concavely-formed vertically-extending seats or recesses. The movable vise member has a second pair of spaced-apart concavely-formed vertically-extending seats substantially opposite to the respective seats in the first pair of seats in the fixed vise member. A substantially cylindrical upstanding clamping member or jaw is received within each of the seats in each pair of seats. Each clamping member has a convexly-formed surface complementary to its respective concavely-formed seat. Means are provided for pivotably mounting each clamping jaw or member on the base for independent pivotal movement, and each clamping jaw has at least one pair of vertically-truncated adjacent flat surfaces for clamping against a workpiece inserted between the jaws. The jaws pivot independently and are adapted to clamp an irregularly-shaped workpiece.

In accordance with yet another aspect of the invention, a clamping apparatus is provided for clamping a workpiece. The clamping apparatus includes a pair of vise jaws supported on a common base and a threaded rod for moving the vise jaws towards and away from one another. The threaded rod has a first portion threaded in a first direction and a second portion threaded in a second direction. An internally threaded nut is threaded in a first direction, and the nut receives the first portion of the threaded rod. An internally threaded jaw is threaded in a second direction for receiving the second portion of the threaded rod and for advancing the threaded rod therethrough. A friction ring is in frictional contact with the internally threaded nut. The friction ring permits the first portion of the threaded rod to rotate within and advance through the internally threaded nut when the movable jaw advances toward the fixed jaw prior to contacting the workpiece. The friction ring also permits the first portion of the threaded rod to cause the nut to rotate with the threaded rod when the movable jaw is in contact with the workpiece.

The internally threaded cylindrical nut and the friction ring can be located either in a notch on the movable vise jaw or in an aperture on the first upstanding flange portion of the base.

The operation of the internally threaded cylindrical nut, the friction ring, the two-way threaded rod, and the first upstanding flange of the base provide a unique result which is that there are two speeds for moving the movable vise member towards the fixed member. One speed of movement occurs when the clamping members are not in engagement with the workpiece. The second speed of movement occurs when the clamping members are engaging the workpiece. The two different speeds are obtained by taking advantage of differences in torque between revolving elements when the movable jaw is moved either without or with engagement of the workpiece.

Taking as an example an embodiment of the invention having an internally threaded nut and friction ring located in a notch on the movable vise member, when the thrust needed to move the movable vise member is the relatively small thrust needed to move a nonclamping movable member towards the workpiece, the static frictional force exerted by the friction ring on the notch is not exceeded. Thereby, the cylindrical nut remains fixed relative to the movable vise member, and the guide screw moves through cylindrical nut. In this condition, the guide screw or threaded rod is also moving through the threads of the first upstanding flange. The resultant effect is that the speed of motion of the movable vise member is the sum of the speeds of motion contributed by the threads in the first upstanding flange and the threads in the cylindrical nut. Stated somewhat differently, since the guide screw is two-way reversibly threaded, the speed of motion of the movable vise member in the unclamped condition is due to the addition of the pitches of the two different threads of the guide screw.

The situation changes when a workpiece is encountered. In this case, the static frictional force exerted by the friction ring on the notch is exceeded. As a result, the cylindrical nut begins to revolve with respect to the notch along with the guide screw as it rotates. Since the cylindrical nut is no longer fixed with respect to the notch and since the cylindrical nut is revolving along with the guide screw, the guide screw does not advance through the cylindrical nut. As a result, when the workpiece is encountered by the movable vise member, the movable vise member is no longer moved toward the fixed element by the cylindrical nut. Instead, the motion of the movable vise member toward the fixed element is caused solely by the rotation of the guide screw in the first upstanding flange.

These and other objects and advantages of the present invention will become apparent from a reading of the following specification, taken in conjunction with the enclosed drawings.

DESCRIPTION OF THE PREFERRED EMBODIMENT

Figure 1:
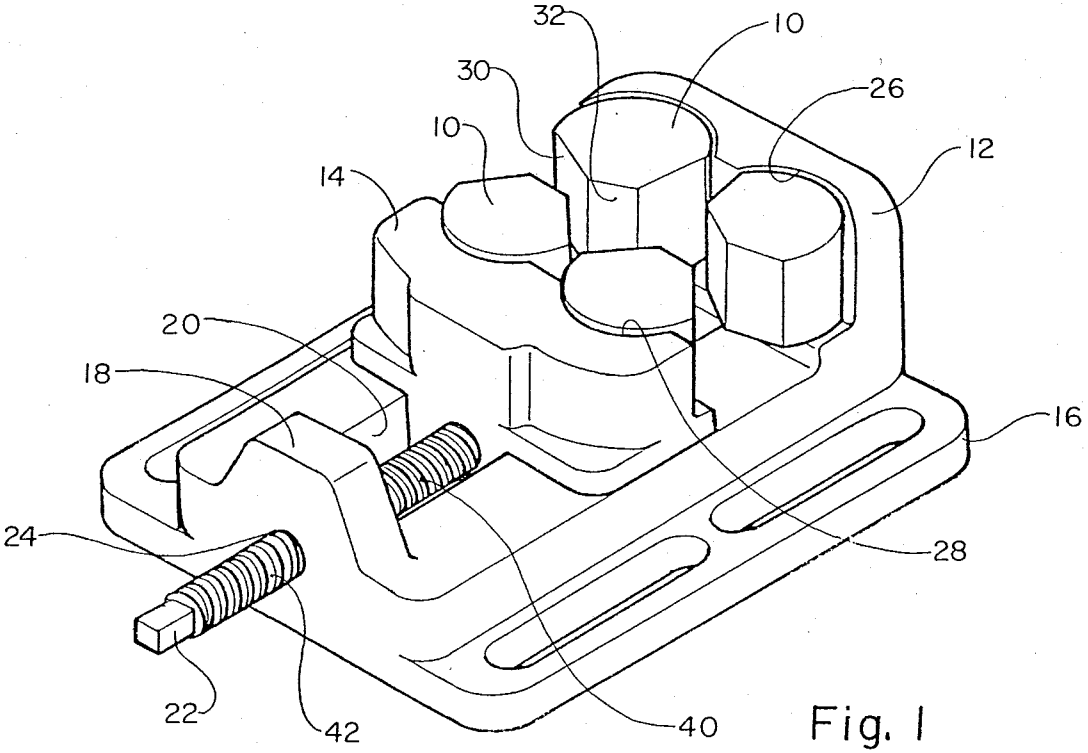
FIG. 1 is a perspective view of a clamping apparatus having a double directional screw shaft and a quick driving structure.

With reference to the drawings, and more particularly to FIG. 1, there is disclosed a preferred embodiment of the clamping apparatus of the present invention. Two pairs of rotatable and substantially cylindrical clamping elements 10 are positioned on the clamping apparatus. One pair of clamping elements 10 is located on a fixed jaw 12, and the second pair is located on the movable vise jaw 14. The jaws 12 and 14 are supported on a generally rectangular base 16 which has a pair of end portions. One end portion is a first upstanding flange 18 formed integrally with the base 16. The second end portion is the fixed jaw 12. The base 16 has a slideway 20 formed therein oriented substantially longitudinally in the base. The movable jaw 14 moves withing the slideway 20. A threaded rod 22 is carried by the movable vise jaw 14 and extends through a cooperating threaded recess 24 in the first upstanding flange 18. The second upstanding flange or fixed jaw 12 has a first pair of spaced-apart concavely-formed vertically-extending seats or recesses 26. The movable vise 14 has a second pair of spaced-apart concavely-formed vertically-extending seats or recesses 28 substantially opposite to the respective seats in the first pair of seats 26 in the fixed vise jaw 12.

The substantially cylindrical upstanding clamping elements 10 are received within each of the recesses 26,28 in each pair of seats. Each clamping element 10 has a convexly-formed surface 11 complementary to its respective concavely-formed seat. Each of the concave recesses and convex surfaces is formed about a vertical axis, wherein, in a cross-sectional plane substantially at right angles to the respective axes, each axis forms the center of a circle substantially defining the respective concave recesses and convex surfaces.

Means are provided for pivotably mounting each clamping element 10 on the base 16 for independent pivotal movement. Each clamping element 10 has at least one pair of vertically-truncated adjacent flat chordal faces 30 and 32 for clamping against a workpiece (not shown) inserted between the clamping elements 10. The clamping elements pivot independently and are adapted to clamp an irregularly-shaped workpiece.

Figure 2:
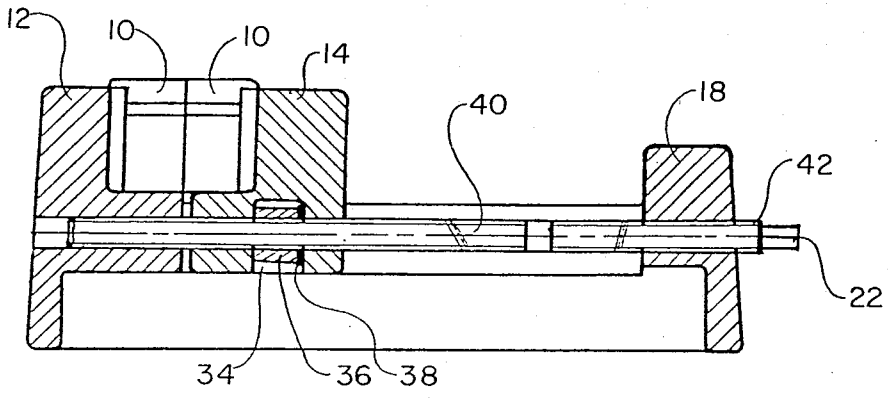
FIG. 2 is a side cross-sectional view of the embodiment shown in FIG. 1.
Figure 3:
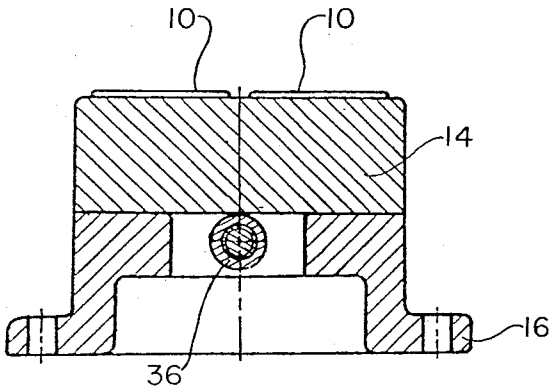
FIG. 3 is a front elevational view of the embodiment shown in FIG. 1.
Figure 4:
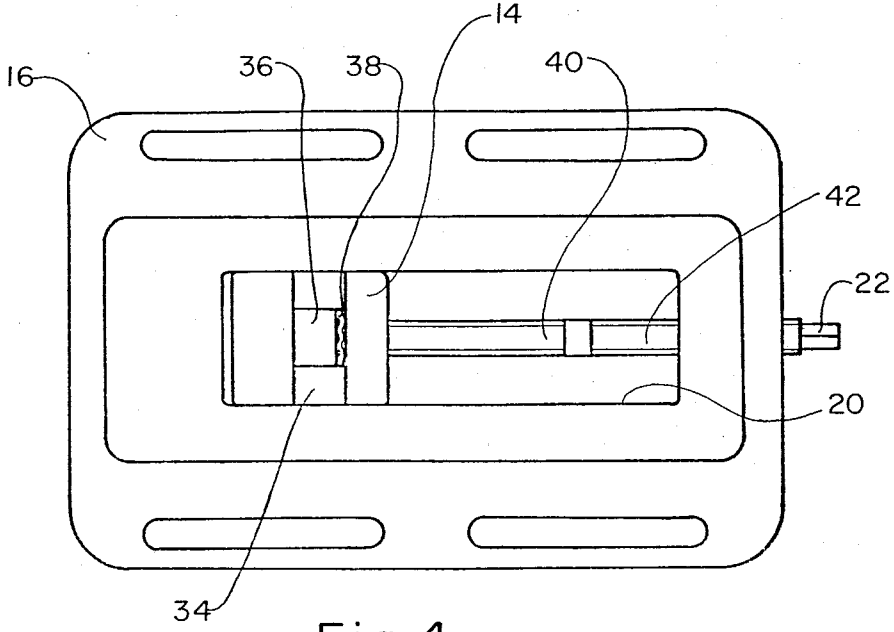
FIG. 4 is a bottom elevational view of the embodiment shown in FIG. 1.
Figure 5:
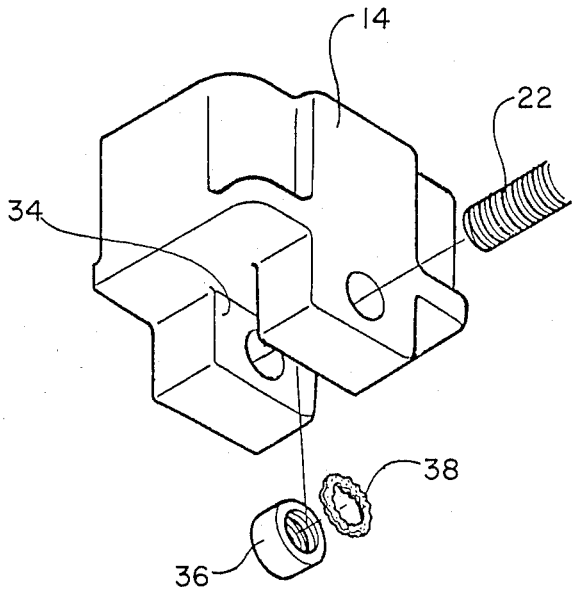
FIG. 5 is an exploded view of the cylindrical nut and friction ring used with the double directional screw in the embodiment shown in FIG. 1.

In accordance with another aspect of the invention, referring to FIGS. 2 and 5, the movable vise jaw 14 has a transverse notch 34 located in its bottom to receive a hollow cylindrical nut 36 which is internally threaded in a first direction. Adjacent to the cylindrical nut 36 is a ring-shaped friction plate 38. The threaded rod 22 has two-way reversed threads 40 and 42 and is threaded into the cylindrical nut 36. The thread 40 of the guide screw 22 running in the first direction is threaded into the cylindrical nut 36. The other thread 42 of the two-way threaded guide screw 22 is threaded in the opposite direction and is in complementary engagement with the first upstanding flange 18.

When the thrust needed to move the movable vise jaw 14 is the relatively small thrust needed to move a nonclamping movable member towards the workpiece, the static frictional force exerted by the friction plate 38 on the notch 34 is not exceeded. Thereby, the cylindrical nut 36 remains fixed relative to the movable vise 14, and the guide screw 22 moves through cylindrical nut 36. In this condition, the guide screw 22 is also moving through the threads of the first upstanding flange 18. The resultant effect is that the speed of motion of the movable vise jaw 14 is the sum of the speeds of motion contributed by the threads in the first upstanding flange 18 and the threads in the cylindrical nut 36. Stated somewhat differently, since the guide screw 22 is two-way reversibly threaded, the speed of motion of the movable vise jaw 14 in the unclamped condition is due to the addition of the pitches of the two different threads 40 and 42 of the guide screw 22.

The situation changes when a workpiece is encountered. In this case, the static frictional force exerted by the frictional plate 38 on the notch 34 is exceeded. As a res. 't, the cylindrical nut 36 begins to revolve with respect to the notch 34 along with the guide screw 22 as it rotates. Since the cylindrical nut 36 is no longer fixed with respect to the notch 34 and since the cylindrical nut 36 is revolving along with the guide screw 22, the guide screw 22 does not advance through the cylindrical nut 36. As a result, when the workpiece is encountered by the movable vise jaw 14, the movable vise jaw 14 is no longer moved toward the fixed jaw 12 by the cylindrical nut 36. Instead, the motion of the movable vise jaw 14 toward the fixed jaw 12 is caused solely by the rotation of the guide screw 22 in the first upstanding flange 18.

Figure 6:
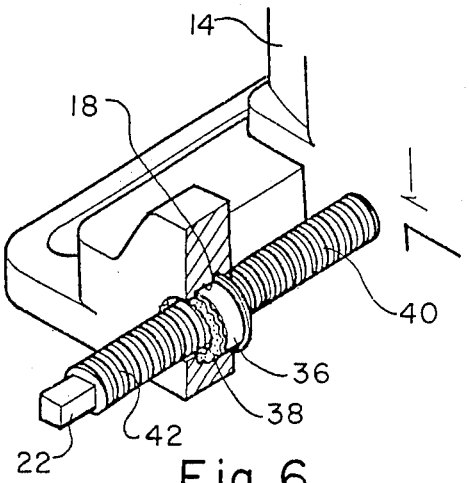
FIG. 6 is a partial cross-sectional view of another embodiment of a quick driving structure with the cylindrical nut and friction ring located in the first upstanding flange.
Figure 7:
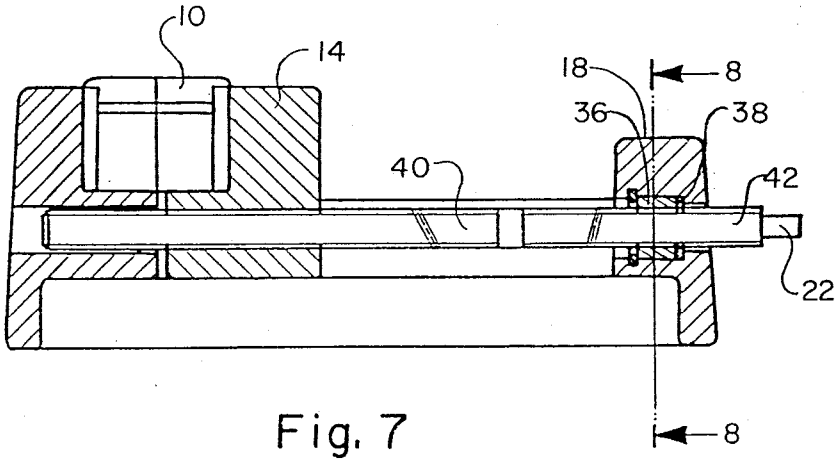
FIG. 7 is a side cross-sectional view of the embodiment shown in FIG. 6.
Figure 8:
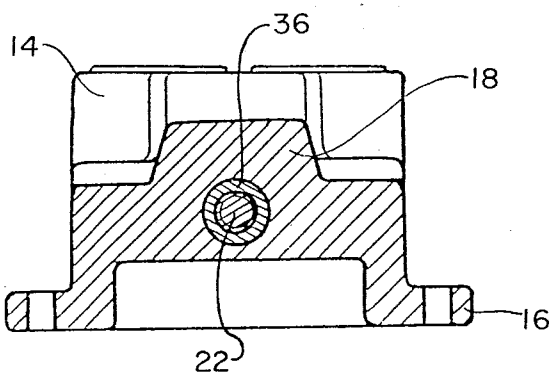
FIG. 8 is a front elevational view of the embodiment shown in FIG. 6.

In accordance with another aspect of the invention, reference is made to FIGS. 6–8 showing a clamping apparatus having an internally threaded cylindrical nut 36 and friction ring 38 located in an aperture in the first upstanding flange 18. The operation of this embodiment works in substantially the same way as the embodiment shown in FIGS. 1–5 described above.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A clamping apparatus, comprising:

a pair of vise jaws supported on a common base, at least one of said vise jaws being movable and at least one of which being fixed, each of the vise jaws having a pair of concave recesses formed therein laterally of each other, a clamping member in each of the recesses and having a convex surface substantially complementary to the respective concave recesses, the concave recesses and convex surfaces being formed about a vertical axis, wherein, in a cross-sectional plane substantially at right angles to the respective axes, each axis forms the center of a circle substantially defining the respective concave recesses and convex surfaces, means for supporting each clamping member for pivotable movement about its respective vertical axis, and each of the clamping members having a plurality of substantially-flat chordal faces intersecting one another and disposed oppositely of the convex surface on the respective clamping member, the chordal faces on one pair of clamping members on a respective vise jaw confronting the chordal faces on the other pair of clamping members on the other respective vise jaw, thereby engaging and securely retaining a workpiece between the respective vise jaws, threaded rod means for moving said vise jaws towards and away from one another, said threaded rod means having a first portion threaded in a first direction and a second portion threaded in a second direction, internally threaded nut means threaded in a first direction, said nut means receiving said first portion of said threaded rod means, either said movable jaw or said fixed jaw having internal threads threaded in a second direction for receiving said second portion of said threaded rod means and for advancing said threaded rod means through said jaw, resilient friction ring means in frictional contact with said internally threaded nut means, said friction ring means for permitting said first portion of said threaded rod means to rotate within and advance through said internally threaded nut means when said movable jaw advances toward said fixed jaw prior to contacting the workpiece, and said friction ring means for permitting said first portion of said threaded rod means to cause said nut means to rotate with said threaded rod means when said movable jaw is in contact with the workpiece.

2. A servo-clamping device, comprising:

a generally rectangular base having a pair of end portions, a first upstanding flange formed integrally with the base at one end portion thereof, a second upstanding flange formed integrally with the base at the other end thereof and constituting a fixed vise jaw, the base having a slideway formed therein substantially longitudinally thereof, a movable vise jaw slidably received within the slideway, threaded rod means for moving said vise jaws towards and away from one another, said threaded rod means having a first portion threaded in a first direction and a second portion threaded in a second direction, said threaded rod carried by the movable vise jaw and extending through a cooperating threaded recess in the first upstanding flange at the one end portion of the base, the second upstanding flange at the other end of the base having a first pair of spaced-apart concavely-formed vertically-extending seats, the movable vise jaw having a second pair of spaced-apart concavely-formed vertically-extending seats substantially opposite to the respective seats in the first pair of seats in the fixed vise jaw, internally threaded nut means threaded in a first direction, said nut means receiving said first portion of said threaded rod means, either said movable jaw or said fixed jaw having internal threads threaded in a second direction for receiving said second portion of said threaded rod means and for advancing said threaded rod means through said jaw, resilient friction ring means in frictional contact with said internally threaded nut means, said friction ring means for permitting said first portion of said threaded rod means to rotate within and advance through said internally threaded nut means when said movable jaw advances toward said fixed jaw prior to contacting the workpiece, and said friction ring means for permitting said first portion of said threaded rod means to cause said nut means to rotate with said threaded rod means when said movable jaw is in contact with the workpiece, a substantially cylindrical upstanding clamping jaw received within each of the seats in each pair of seats, each clamping jaw having a convexly-formed surface complementary to its respective concavely-formed seat, means for pivotably mounting each clamping jaw on the base for independent pivotal movement, and each clamping jaw having at least one pair of vertically-truncated adjacent flat surfaces for clamping against a workpiece inserted between the jaws, wherein the jaws pivot independently and are adapted to clamp an irregularly-shaped workpiece.

3. A clamping apparatus for clamping a workpiece, said clamping apparatus comprising:

a pair of vise jaws supported on a common base, at least one of said vise jaws being movable and at least one of which being fixed, threaded rod means for moving said vise jaws towards and away from one another, said threaded rod means having a first portion threaded in a first direction and a second portion threaded in a second direction, wherein one threaded portion of said threaded rod is in engagement with a stationary structure of said clamping apparatus and wherein the other threaded portion of said threaded rod is in engagement with a movable structure of said clamping apparatus, internally threaded nut means threaded in a first direction, said nut means receiving said first portion of said threaded rod means, either said movable jaw or said fixed jaw having internal threads threaded in a second direction for receiving said second portion of said threaded rod means and for advancing said threaded rod means through said jaw, resilient friction ring means in frictional contact with said internally threaded nut means, said friction ring means for permitting said first portion of said threaded rod means to rotate within and advance through said internally threaded nut means when said movable jaw advances toward said fixed jaw prior to contacting the workpiece, and said friction ring means for permitting said first portion of said threaded rod means to cause said nut means to rotate with said threaded rod means when said movable jaw is in contact with the workpiece.

4. The clamping apparatus described in claim 3 wherein said internally threaded nut means and said friction ring means are located in a notch on said movable vise jaw.

5. The clamping apparatus described in claim 3 wherein said internally threaded nut means and said friction ring means are located in an aperture on a stationary upstanding flange portion of said base.

* * * * *